US005217854A

United States Patent [19]

Abe

[11] Patent Number: 5,217,854

[45] Date of Patent: Jun. 8, 1993

[54] VACUUM PACKAGED COLOR DEVELOPING COMPOSITION

[75] Inventor: Akira Abe, Minami-ashigara, Japan

[73] Assignee: Fuji Photo Film Co., Ltd., Kanagawa, Japan

[21] Appl. No.: 696,884

[22] Filed: May 8, 1991

[30] Foreign Application Priority Data

May 10, 1990 [JP] Japan ..... 2-120613

[51] Int. Cl.[5] ..... G03C 5/18; G03C 5/26

[52] U.S. Cl. ..... 430/465; 430/464; 430/466; 430/450; 430/403; 206/524.8; 206/578

[58] Field of Search ..... 430/403, 464, 465, 466, 430/450; 206/524.8, 578

[56] References Cited

U.S. PATENT DOCUMENTS

| | | | |
|---|---|---|---|
| Re. 28,185 | 10/1974 | Bimmler et al. | 430/484 |
| 4,770,979 | 9/1988 | Koboshi et al. | 430/466 |
| 4,780,357 | 10/1988 | Akao | 206/455 |
| 4,784,906 | 11/1988 | Akao | 206/455 |

FOREIGN PATENT DOCUMENTS

| | | | |
|---|---|---|---|
| 0196551 | 10/1990 | European Pat. Off. . | |
| 3063037 | 3/1988 | Japan | 430/464 |
| 6652 | of 1909 | United Kingdom . | |
| 1464732 | 2/1977 | United Kingdom . | |
| 2112954 | 7/1983 | United Kingdom . | |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A vacuum package of a color developing composition comprising an aromatic primary amine color developing agent and other components is obtained by vacuum packaging the components in a bag as a layered structure of at least three solid state layers each consisting of a distinct component. A bottom layer consists of the color developing agent. A layer containing a component selected from an organic acid, brightener, polymer, surface active agent, and neutral salt is disposed adjacent the color developing agent layer. Additional layers containing a preservative and an alkaline agent are stacked on the bottom layer through the adjacent layer. The packaged composition is taken out of the bag and diluted with water to prepare a color developer.

6 Claims, 1 Drawing Sheet

VACUUM PACKAGED COLOR DEVELOPING COMPOSITION

This invention relates to a vacuum package of a color developing composition from which a color developer is prepared on use.

BACKGROUND OF THE INVENTION

Color photographic silver halide photosensitive materials (to be simply referred to as photosensitive materials), after exposure, are processed through a series of steps of color development, desilvering, washing, stabilization, and the like. There are utilized a color developer for color development, a bleaching solution, bleach-fixing solution, and fixer for desilvering, city water or ion-exchanged water for washing, and a stabilizer for stabilization. The photosensitive materials are processed by dipping them in the respective processing solutions which are usually adjusted to a temperature of about 30° to 40° C. Since the processing solutions lower their processing ability upon repetition of processing and with the lapse of time, it is a common practice to replace the respective solutions by fresh solutions partially or entirely in a replenishing or batchwise mode.

Prior to the start of processing operation, the user has to prepare some processing solutions. Most chemical agents used for such preparation are solid and if kept in contact, can react one another to form undesirable reaction products. It is not recommended to deliver a mixture of chemical agents to the user. Therefore, chemical agents of potential reaction are received in separate packages which are delivered to the user. Separate packaging increases the costs for packages and transportation and leaves the possibility that unskillful users wrongly blend the chemical agents.

It is a common practice to separate the components of a processing solution into two or more parts and deliver the respective parts in concentrate form to the user so that dilution is the only operation that the user has to take in preparing a processing solution. For example, a color developer is available as three concentrate parts, a first part containing a color developing agent, a second part containing an alkaline agent, and a third part containing a preservative such as hydroxylamine sulfate. Although these parts are concentrates, they are received in separate containers if they contain potentially reactive components. This system is not compact in this sense. In addition, since the concentrate parts are liquid, they require a dissolving step prior to their preparation, need careful handling during transportation, and allow formation of deposits during transportation or storage which are often difficult to dissolve again.

European Patent Application Publication No. 196551 discloses a new approach in which two or more potentially reactive particles among components of a photographic processing composition are stacked as layers through an inert layer so as to prevent their reaction and vacuum packaged. This publication sets forth an example using a black-and-white photographic developing composition, but is silent about the best mode of stacking for a color photographic color developing composition.

SUMMARY OF THE INVENTION

An object of the present invention is to provide a vacuum packaged color developing composition which is compact in shape and ready to prepare a solution therefrom and has a sufficient storage life to provide the solution with satisfactory photographic activities on actual use.

The present invention is directed to a vacuum packaged color developing composition comprising an aromatic primary amine color developing agent and other components. A layered structure including at least three solid state layers each consisting of a different component or components from the other layers is received in a container in a vacuum sealed manner. A first layer contains the color developing agent, and in a preferred embodiment, the one layer consists solely of the color developing agent. A second layer containing an organic acid, brightener, polymer, surface active agent or neutral salt is disposed adjacent the first layer. The first layer is disposed remote from a third layer containing a preservative. That is, at least the adjacent layer intervenes between the first layer and the third layer. Most often, the first or color developing agent layer is a bottom layer. The first layer, the second layer, and the third layer are stacked in the described order while any desired layers may intervene therebetween insofar as two adjoining ones of the layers are inert to one another.

According to the present invention, the components of a color developing composition are received in a container as layers each consisting of a different component from the other layers in principle, and the container is vacuum sealed to provide a single compact vacuum package containing all the components in a solid state layered arrangement. The vacuum packaging eliminates the risk of intermixing of the components because the tightly compacted layer structure retains the respective layers intact.

The layer containing the neutral salt is disposed contiguous to the layer containing the color developing agent, thereby providing obstruction against contact between the color developing agent and an alkaline agent. Since the oxidation of the color developing agent promoted by the alkaline agent is restrained, the packaged composition does not lower its processing ability during long-term shelf storage. The neutral salt may be either an antifoggant or an inert substance added separately therefrom. The layer disposed adjacent the first layer containing the color developing agent may also be a layer containing an organic acid, brightener, polymer or surface active agent because it can serve for the same separation function.

The layered arrangement of the invention prohibits any contact between the color developing agent and the preservative, with the attendant benefit of improved shelf stability.

Preparation of a processing solution is quite easy because the user is only required to take out the layer structured composition from the vacuum package and dissolve it in a predetermined volume of water. A color developer prepared from the packaged composition is effective in processing photosensitive material to produce images with better photographic properties.

BRIEF DESCRIPTION OF THE DRAWING

The structure, operation and advantages of the presently preferred embodiment of this invention will become further apparent upon consideration of the following description, taken in conjunction with the accompanying drawing, wherein.

the only figure.

DETAILED DESCRIPTION OF THE INVENTION

Figure 1:
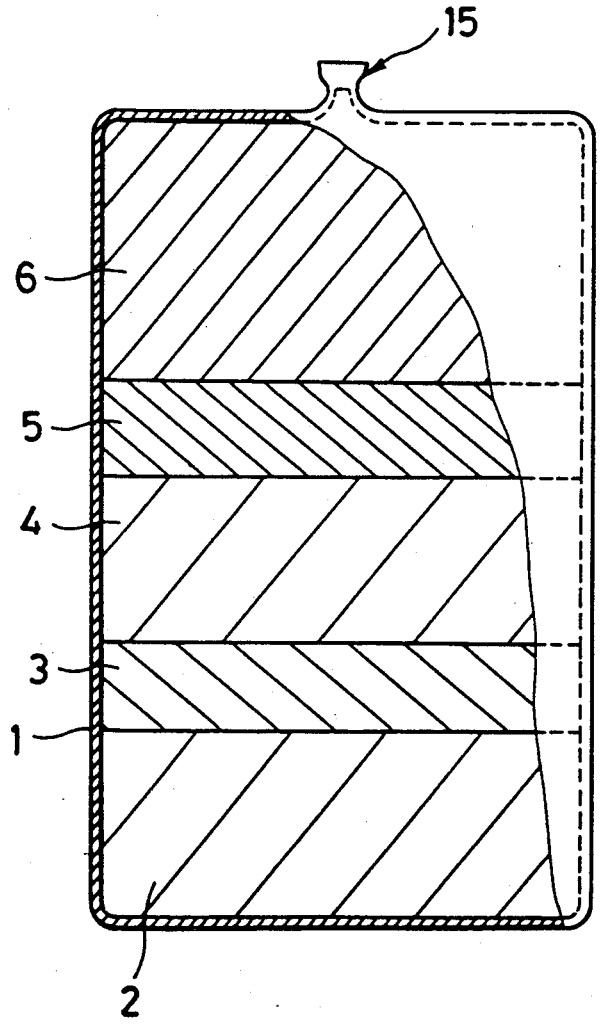
FIG. 1 is a partially cross sectional elevation of a developer composition vacuum package according to the present invention.

The vacuum packaged color developing composition of the present invention is obtained by receiving an aromatic primary amine developing agent and other components of a color developing composition in a container 1 as distinct layers 2, 3, 4, 5, and 6 as shown in FIG. 1 and sealing the container under vacuum such that the pressure in the sealed container is less than the atmospheric pressure.

The container 1 used herein is of any desired material which can withstand vacuum packaging and does not react with the components of the color developing composition upon contact. Preferred examples include resins such as polyethylene, polypropylene, nylon, polyvinylidene chloride, and polyethylene terephthalate and aluminum and other metal foils surface coated with such resins.

The pressure within the container may be up to 100 mmHg, preferably 50 to 1 mmHg, more preferably 30 to 1 mmHg after sealing. The vacuum can avoid any influence of oxygen and moisture on the color developing composition.

A package is obtained by supplying a selected component into a container 1 through an inlet 15 to form a bottom layer 2 of uniform thickness, and stacking subsequent layers in the same manner, and vacuum sealing the container in a well-known manner, for example, by heating sealing the inlet 15. As a result of vacuum packaging, the respective layers 2, 3, 4, 5 and 6 define distinct interfaces with adjacent layers and form a somewhat rigid integral structure as a whole. Little or no mutual diffusion of the components between the adjacent layers with time occurs and if any, to a negligible extent from a point of view of photographic performance.

The layer arrangement in the invention includes at least three layers. A first layer contains a color developing agent and most often forms a bottom layer 2 in FIG. 1. In order to prevent the color developing agent from contacting and reacting with an alkaline agent, a layer 3 is disposed adjacent the color developing agent layer 2.

The adjacent layer 3 may be composed of either a selected component or components of the color developing composition or an extra component which does not affect photographic performance. More particularly, at least one member selected from the group consisting of neutral salts, organic acids, brighteners, polymers, and surface active agents is used to construct the adjacent layer 3.

The neutral salts include alkali metal halides such as sodium chloride, potassium chloride, potassium bromide, and sodium bromide; alkali metal sulfates such as sodium sulfate and potassium sulfate; and alkali metal nitrates such as sodium nitrate and potassium nitrate. Some of them are effective chemical agents as antifoggants while the remaining salts are non-functional agents which do not have substantial influence on development, like sodium chloride as used in the development of silver iodobromide photo-sensitive materials (often, picture taking photosensitive materials). The neutral salt component is preferably used in an amount of up to 10% by weight, more preferably 1 to 5% by weight based on the total weight of the composition.

The organic acids are mainly chelating agents and the brighteners are mainly used for the processing of printing photosensitive materials. The organic acids include diethyleneaminepentaacetic acid, catecholdisulfonic acid, catecholtrisulfonic acid, ethylenediamine tetramethylene phosphonic acid, nitrilotrimethylene phosphonic acid, 1-hydroxyethylidene-1,1-diphosphonic acid, EDTA, NTA, TTHA, hydroxyethyliminodiacetic acid, and iminodiacetic acid. Preferred are those acids having an overall formation constant of at least 10, especially at least 15 with Fe(III) ion because they are effective for maintaining the developing agent stable when disposed in close contact with the developing agent. Among others, diethyleneaminepentaacetic acid, catecholdisulfonic acid, catecholtrisulfonic acid, ethylenediamine tetramethylene phosphonic acid, nitrilotrimethylene phosphonic acid, and 1.hydroxyethylidene-1,1-diphosphonic acid are preferred, with the diethyleneaminepentaacetic acid and catecholdisulfonic acid being most preferred. The organic acid is used in an amount of about 0.5 to 10 grams per liter of the color developer.

The brightener is preferably a triazinylstilbene brightener of the following general formula.

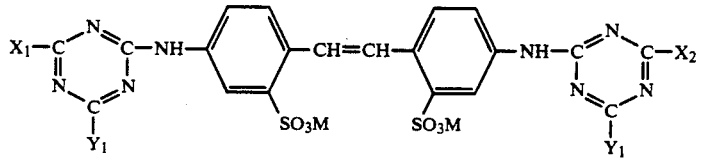

In the formula, $X_1$, $X_2$, $Y_1$, and $Y_2$ each are a hydroxyl group, halogen atom such as chloro or bromo, morpholino group, alkoxy group (e.g., methoxy, ethoxy, and methoxyethoxy), aryloxy group (e.g., phenoxy and p-sulfophenoxy), alkyl group (e.g., methyl and ethyl), aryl group (e.g., phenyl and methoxyphenyl), amino group, alkylamino group (e.g., methylamino, ethylamino, propylamino, dimethylamino, cyclohexylamino, β-hydroxyethylamino, di(β-hydroxyethylamino, β-sulfoethylamino, N-(β-sulfoethyl)-N'-methylamino, and N-(β-hydroxyethyl-N'-methylamino)), or arylamino group (e.g., anilino, o-, m- and p-sulfoanilino, o-, m- and p-chloroanilino, o-, m- and p-toluidino, o-, m- and p-carboxyanilino, o-, m- and p-hydroxyanilino, sulfonaphthylamino, o-, m- and p-aminoanilino, o-, m- and p-anidino), M is a hydrogen atom, sodium, potassium, lithium or ammonium.

Illustrative, non-limiting examples of the brightener are compounds A-1 to A-15 as given below.

A-1
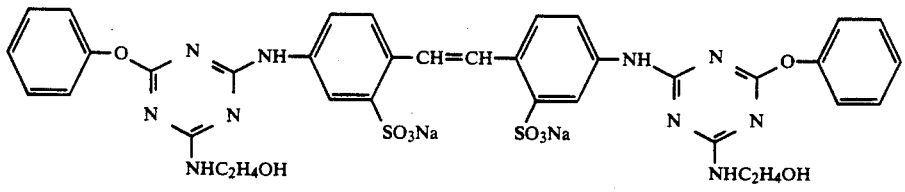
A-2
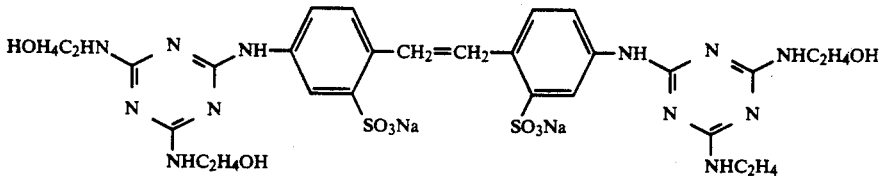
A-3
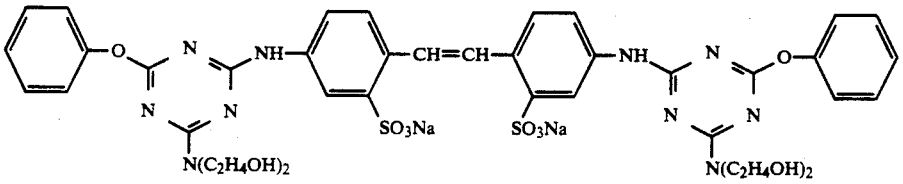
A-4
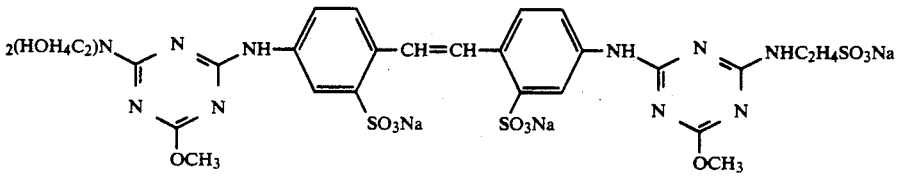
A-5
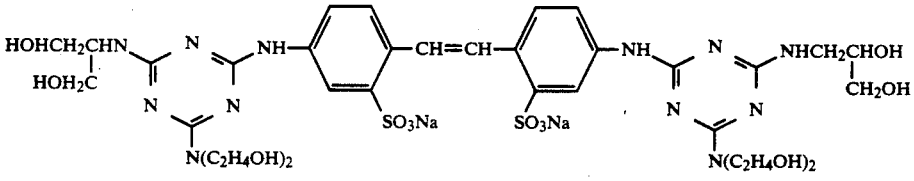
A-6
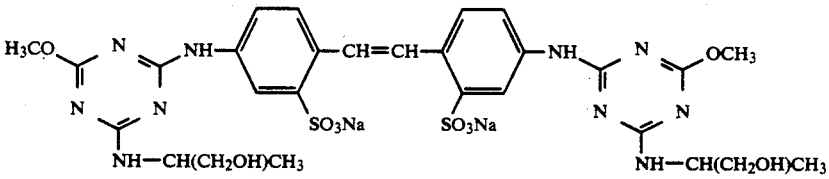
A-7
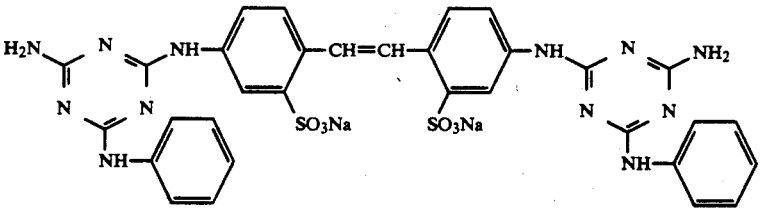
A-8
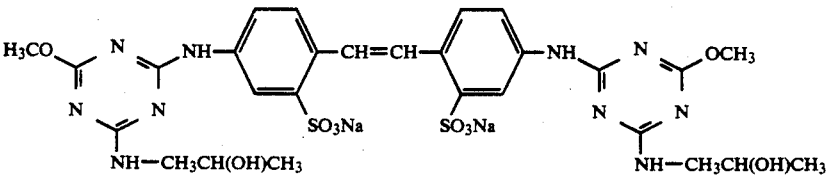

-continued

A-9

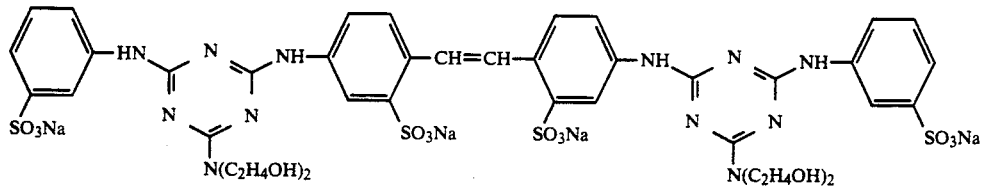

A-10

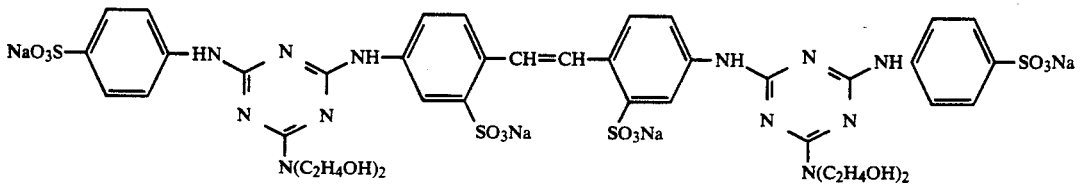

A-11

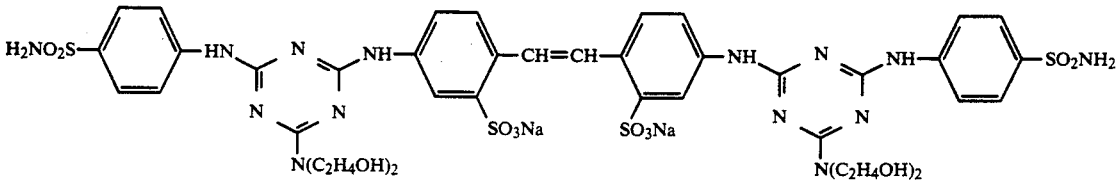

A-12

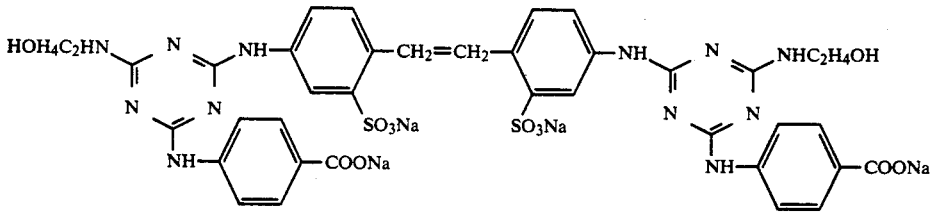

A-13

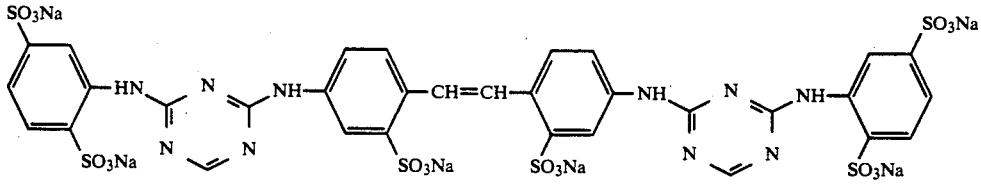

A-14

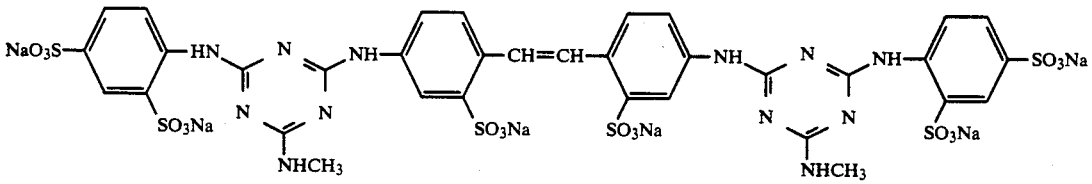

A-15

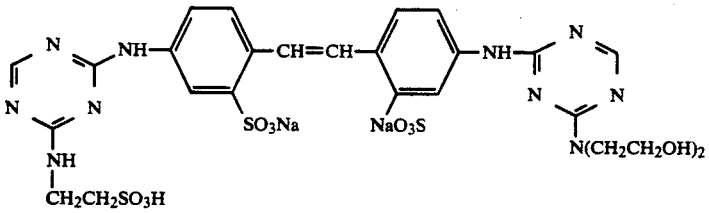

The triazinylstilbene brighteners may be synthesized by a conventional method as described in Japan Chemicals Industry Associate ed., "Keiko-Zohakuzai (Fluorescent Brighteners)", August 1976, page 8.

The triazinylstilbene brightener is preferably used in an amount of about 0.2 to 6 grams, more preferably about 0.4 to 3 grams per liter of the color developer.

The polymers used herein preferably have a molecular weight of about 1,000 to about 50,000 and a degree of polymerization of 100 to 5,000, especially 200 to 2,000 though not limited thereto. These polymers are normally used for the purpose of preventing precipitation of the color developing agent. Exemplary are copolymers of vinyl alcohol or vinyl pyrrolidone. Copolymerizable monomers may be selected from acrylates, acrylamides, ethyleneimines, vinyl pyridine, styrene, vinylmethylimidazole, ionene, acryl, acrylic acid, methacrylic acid, maleic anhydride, maleic acid, styrenesulfonic acid, vinylbenzoic acid, phenol, polyestersilicone, vinylsuccinimide, acrylonitrile, vinyl esters, vinyl alcohol, and vinyl pyrrolidone. Among others, copolymers containing at least 20 mol %, preferably at least 40 mol %, more preferably at least 70 mol % of vinyl alcohol or vinyl pyrrolidone are useful in practice because they are soluble in water to form a homogeneous solution.

Illustrative, non-limiting examples of the polymer are polymers B1 to B20 as given below.

B-1 polyvinyl alcohol
B-2 vinyl alcohol/vinyl acetate copolymer
B-3 vinyl alcohol/acrylic acid copolymer
B-4 vinyl alcohol/vinyl pyrrolidone copolymer
B-5 vinyl alcohol/methacrylic acid copolymer
B-6 vinyl alcohol/maleic acid copolymer
B-7 vinyl alcohol/acrylonitrile copolymer
B-8 vinyl alcohol/acrylate copolymer
B-9 vinyl alcohol/acrylate/acrylic acid copolymer
B-10 polyvinyl pyrrolidone
B-11 vinyl pyrrolidone/acrylate copolymer
B-12 vinyl pyrrolidone/vinyl acetate copolymer
B-13 vinyl pyrrolidone/methacrylic acid copolymer
B-14 vinyl pyrrolidone/maleic acid copolymer
B-15 vinyl pyrrolidone/acrylamide copolymer
B-16 vinyl pyrrolidone/methacrylamide copolymer
B-17 vinyl pyrrolidone/acrylic acid copolymer
B-18 vinyl pyrrolidone/acrylic acid copolymer
B-18 vinyl pyrrolidone/acrylate/acrylic acid copolymer
B-19 vinyl pyrrolidone/vinyl alcohol/acrylic acid copolymer
B-20 vinyl pyrrolidone/vinyl alcohol/acrylate copolymer The polymer is preferably used in an amount of about 0.05 to 2 grams, more preferably about 0.1 to 1 grams per liter of the color developer.

The surface active agent used herein may be anionic or nonionic. Illustrative, non-limiting examples of the surface active agent used herein are compounds C-1 to C-8 and D-1 to D-5 as given below.

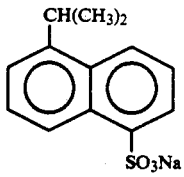

C-1

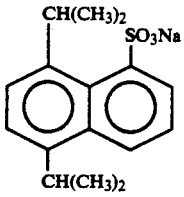

C-2

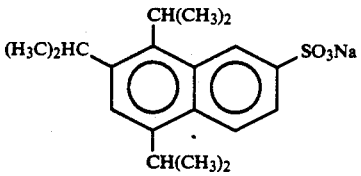

C-3

-continued

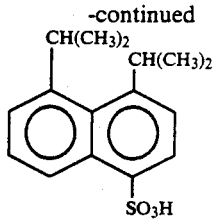

C-4

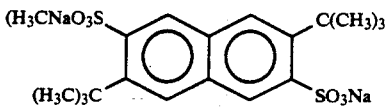

C-5

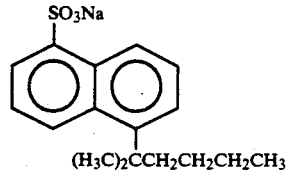

C-6

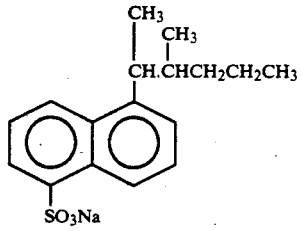

C-7

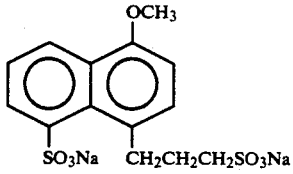

C-8

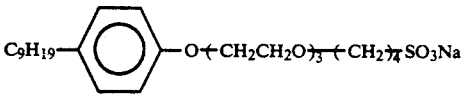

D-1

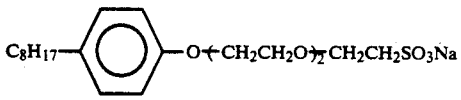

D-2

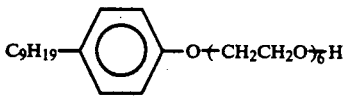

D-3

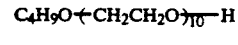

D-4

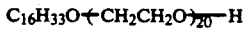

D-5

The surfactant is preferably used in an amount of about 0.1 to 10 grams per liter of the color developer.

The adjacent and other inert layers may be constructed from the foregoing five types of components alone or a mixture of two or more components. There may be used, for example, a mixture of neutral salts such as a mixture of potassium bromide and sodium chloride, a mixture of a chelating agent and a brightener such as a mixture of diethylenetriaminepentaacetic acid and a diaminostilbene brightener, and a mixture of chelating agents such as a mixture of ethylenediaminetetraacetic acid and ethylenediamine tetramethylene phosphonic acid. Use of a preblend of two or more components leads to improved productivity because the number of container charging steps is reduced as well as the manufacturing time and the packaging installation becomes simpler. Further, a larger shot allows for more precise metering and charging of a more precise quantity therewith, also contributing to productivity.

These compounds may be present in an amount of at least 5% by weight of the adjacent layer. The adjacent layer may be constructed from a plurality of sub-layers and have a minimum thickness of 3 mm.

The layer containing the color developing agent is most often a layer consisting of the color developing agent because better photographic performance is expected. If desired, the color developing agent may be mixed with a brightener, neutral salt, polymer, surface active agent or chelating agent. Where it is desired to use a plurality of color developing agents, there may be provided a corresponding plurality of layers each for one agent or a layer containing a mixture of color developing agents.

The arrangement of an intervening layer adjacent or contiguous to the color developing agent layer as mentioned above restrains the direct contact of the color developing agent layer with a layer containing an alkaline agent or preservative. Differently stated, the alkaline agent or preservative layer is stacked on the color developing agent layer through at least one intervening layer.

The preservatives used herein include sulfite salts, solid hydroxylamines, and hydrazines, often used in combination of two or more. It is to be noted that the sulfite salts are used in minute amounts for the development of printing photosensitive materials bearing a high silver chloride content emulsion.

Contact of the color developing agent with sulfites is prohibited because the color developing agent is usually present in the form of a sulfate or hydrochloride salt exhibiting sufficiently strong acidity to decompose the sulfites to give off sulfur dioxide gas and because similar release of sulfur dioxide gas is likely to occur upon dissolving in water. Unexpectedly, sulfites tend to promote deterioration of the developing agent. Since preservatives such as hydroxylamines and hydrazines give rise to oxidation-reduction reaction with the color developing agent to produce various intermediates, it is preferred for long-term storage to keep them out of contact in the container. Also it is unexpected from the known function of the preservative to protect the developing agent that long term contact of the developing agent with organic preservatives such as hydroxylamines results in desensitization or formation of fogging substances.

Some hydroxylamines are solid in nature and some hydroxylamines like diethylhydroxylamine are liquid as such, but can be converted into sulfate or hydrochloride salts which are available as powder. In either case, hydroxyl amines are used to form a layer in solid state. If it is desired to use a hydroxylamine in liquid state, the liquid hydroxylamine should be excluded from the vacuum package and received in a separate container. In the practice of the invention, preference is given to solid hydroxylamines. The same applies to hydrazines.

It is to be understood that hydroxylamines and hydrazines which can be used as preservatives for color developing agents are used in color developing compositions, but not in black-and-white developing compositions.

Except the above-mentioned requirement, the hydroxylamine or hydrazine-containing layer may be disposed adjacent a suitable layer depending on whether the hydroxylamine or hydrazine is acidic, neutral or alkaline. It is not recommended to introduce hydroxylamines into the alkaline agent layer or locate hydroxylamines adjacent the alkaline agent layer because fogging is enhanced. This phenomenon becomes severer with hydroxylamine.

A layer containing an alkaline agent used in the practice of the invention is often a layer consisting of an alkaline agent. The term alkaline agent includes a pH buffer agent. Since a plurality of alkaline agents are usually used in combination, there may be provided a corresponding plurality of layers each for one agent or a layer containing a mixture of agents. It is preferred for efficient production to form a layer from a preblend of alkaline agents. It is also permissible to combine the alkaline agents with sulfites, and as the case may be, with neutral salts, alkali metal salts of chelating agents, or organic antifoggants such as 1-phenyl-5-mercaptotetrazole and benzotriazole.

In the practice of the invention, layers are stacked while meeting the above-mentioned requirements. In principle, a layer containing an acidic compound is disposed on the side of the color developing agent layer and a layer containing an alkaline compound is disposed on the side of the alkaline agent layer. Preferably, at least one layer containing a neutral compound (such as a neutral salt, brightener or nearly neutral salt of chelating agent) is interposed between the layer containing an acidic compound and the layer containing an alkaline compound.

The acidic compounds used herein include organic acids, such as hydroxylamines, typically hydroxylamine sulfuric acid salt. In principle, a layer disposed nearer to the color developing agent is constructed from a compound having higher acidity, and a layer disposed nearer to the neutral compound is constructed from a compound having lower acidity.

The alkaline compounds other than the alkaline agents include sulfites, and alkaline salts of chelating agents such as pentasodium diethylenetriamine pentaacetate. In principle, a layer containing the most alkaline compound among the alkaline agents is disposed remote from the neutral compound and a layer disposed nearer to the neutral compound is constructed from a compound having lower alkalinity.

The above-mentioned layer arrangement is preferred in improving storage stability.

Preferred layer arrangements are three to five layer arrangements. One exemplary preferred embodiment illustrated in FIG. 1 is a five layer arrangement in which each of layers 2 to 6 is formed from a component or a preblend of components as previously mentioned. Most often, the color developing agent layer is forms an outermost, preferably bottom, layer 2 of the layer arrangement. Exemplary layer arrangements are (A) a three layer arrangement in which a layer 3 containing a component selected from an organic acid, brightener, polymer, surfactant, and neutral salt intervenes between a layer 2 containing a color developing agent and a layer containing an alkaline agent and a preservative; (B) a four layer arrangement in which a layer 3 containing a component selected from an organic acid, brightener, polymer, surfactant, and neutral salt is disposed adjacent a layer 2 containing a color developing agent, and a layer containing a preservative and a layer containing an alkaline agent are stacked on the layer 3; and (C) a five layer arrangement in which a layer 2 containing a color developing agent, a layer 3 containing a component selected from an organic acid, brightener, polymer, surfactant, and neutral salt, a layer 4 containing a preservative, a layer 5 containing a component selected from an organic acid, brightener, polymer, surfactant, and neutral salt, and a layer 6 containing an alkaline agent are stacked in the described order as just illustrated in FIG. 1. Five layer structures as stacked in arrangement (C) are preferred.

It is preferable to stack layers such that a sulfite salt is located close to an acidic compound because release of sulfur dioxide gas upon dissolving is prohibited.

It is permissible to dispose a layer containing a neutral compound between layers each containing an acidic compound or between layers each containing an alkaline compound.

Such a layer containing a neutral compound is preferably disposed between layers each containing an acidic compound. Shelf life is increased by locating such an intermediate neutral layer between the color developing agent layer and the hydroxylamine layer to space them apart a larger distance.

The acidic compound, neutral compound and alkaline compound used herein, when defined in terms of acid dissociation constant Ka, have a pKa (ionic strength 0.1 mol/l at 25° C.) of less than 6, 6 to less than 8, and at least 8, respectively. In the case of polybasic acids such as organic acids, the primary acid dissociation constant is a measure.

In forming layers in a container, the order of furnishing compounds into the container is not particularly limited. Preferably, the color developing agent is first fed into the container so that it may come in contact with water last in diluting the packaged composition into a solution. In order to prevent the color developing agent from being oxidized with dissolved oxygen in water upon such preparation, a preservative such as sodium sulfate and hydroxylamine should preferably come in contact with water prior to the color developing agent. Further, in order to prevent the sodium sulfite from being decomposed with the acidic color developing agent, the alkaline agent should preferably come in contact with water prior to the color developing agent. It is therefore preferable to feed the components into the container for forming layers so as to help the components of the layered structure to contact with water in such order.

It is also possible to prepare powder agents by freeze drying. The powder agents may be granular. Preferably, the powder has a particle size of 150 to 3,000 μm, more preferably 500 to 1,500 μm.

The vacuum packaged color developing composition is in the form of a stack of layers having a thickness corresponding to the requisite amounts of the respective components to prepare a batch of color developer. For preparing 10 liters of color developer, the layered structure has a total thickness of about 50 to 300 mm, the color developing agent layer has a thickness of about 5 to 30 mm, and the alkaline agent layer has a thickness of about 10 to 250 mm. The layers constructed from neutral compounds providing essential separation between layers each containing an acidic compound and between layers each containing an alkaline compound have a total thickness of about 2 to 50 mm.

The layers constructed from acidic compounds have a total thickness of about 2 to 30 mm and the layers constructed from alkaline compounds have a total thickness of about 2 to 30 mm, provided that the total thickness includes the thickness of an intervening layer of a neutral compound if any.

It is also possible to divide a single compound into two or more parts which are added to different layers.

The layered structure is compact since it generally has a total volume of about 200 to 1000 $cm^3$.

On use of the vacuum packaged color developing composition of the invention, the package is opened and the layered structure is placed in a predetermined volume of water for dissolution. A recommended practice is to cut the package 1 on the side of the alkaline agent layer 6, that is, at the seal 15 and to introduce the layered structure into water with the alkaline agent layer 6 first (see FIG. 1).

The chemical components which can be used in the present invention are solid components in principle. As previously described, if it is desired to use a hydroxylamine in liquid state, the liquid hydroxylamine should be received in a separate container and the present invention is applied to only the remaining solid components. If a liquid component is low volatile and added in a minor amount, it is possible to impregnate a major component with the liquid component so that the present invention may be applied. Examples of the liquid components include alkanol amines such as triethanol amine and diethanol amine, and alcohols and glycols such as benzylalcohol and diethylene glycol. Examples of the major components which can be impregnated with the liquid components include alkaline agents or pH buffer agents such as potassium carbonate and sodium bicarbonate, neutral salts such as sodium chloride and potassium bromide, and organic acids such as diethylenetriamine pentaacetic acid. If a liquid component like diethylhydroxylamine can be converted into a powdery salt with an acid as previously described, it should be converted into powder or solid form so that it may be used in the present invention.

On use, the vacuum packaged color developing composition of the invention is diluted with water to form a color developer which can be used in processing a variety of color photographic silver halide photosensitive materials including well-known color photosensitive materials, for example, color paper, color reversal paper, still picture color negative film, color reversal film, motion picture color negative or positive film, and transmission (film) or reflection (paper) type direct positive photosensitive materials.

Examples of the color paper include Fuji Color Paper Super FA paper and Super HG paper commercially available from Fuji Photo-Film Co., Ltd., 2001 paper commercially available from Eastman Kodak, Konicolor QA paper commercially available from Konica Co., Ltd., and Agfa Color Paper Type 9 commercially available from Agfa Gevaert A.G.

Examples of the color negative film include Fuji Color Super HR II 100, Super HG100, Super HG200, Super HG400, Super HR II 1600, Super HG1600, and Reala commercially available from Fuji Photo-Film Co., Ltd., and Kodacolor Gold 100, Gold 200, Gold 400, Gold 1600, Ektar 25, Ektar 100 and Ektar 1000 commercially available from Eastman Kodak.

Now, the respective components constituting the color developing composition of the invention are described. The amounts specified in the following description are the amounts required when used as a color developer.

The color developing agents used herein are aromatic primary amine compounds including conventional well-known compounds widely used in various color photographic processes. Preferred, non-limiting examples are N,N-dialkyl-p-phenylenediamine color developing agents including (1) 4-(N-ethyl-N-β-hydroxyethylamino)-2-methylaniline sulfate,
(2) 4-(N-ethyl-N-β-methanesulfonamidoethylamino)-2-methylaniline sulfate,
(3) 4-(N-ethyl-N-β-methoxyethylamino)-2-methylaniline-p-toluenesulfonate,
(4) 4-(N,N-diethylamino)-2-methylaniline hydrochloride,
(5) 4-(N-ethyl-N-dodecylamino)-2-methylaniline sulfate,
(6) N,N-diethyl-p-phenylenediamine hydrochloride,
(7) 4-(N-ethyl-N-β-hydroxyethylamino)aniline sulfate, and
(8) 4-(N-ethyl-N-γ-hydroxypropylamino)-2-methylaniline sulfate.

The color developing agent is generally used in amounts of 0.013 to 0.065 mol per liter of the color developer, but preferably in amounts of 0.016 to 0.048 mol, more preferably 0.019 to 0.032 mol per liter of the color developer for quicker processing purposes.

In general, the color developing agents are used singly. However, a mixture of such agents may be used for a particular purpose such as discrimination and hue improvements without adversely affecting the benefits of the present invention. Preferred combinations are combinations of compounds (1) and (2), (1) and (3), (2) and (3), (1) and (7), and (2) and (7), for example. Most often, compound (1) is used for picture taking color photosensitive materials and compounds (2), (1) and (7) for printing color photosensitive materials.

The preservatives used herein include solid and liquid compounds, for example, hydroxylamines such as hydroxylamine, diethylhydroxylamine, N,N-disulfoethylhydroxylamine, and N,N-dicarboxyethylhydroxylamine, and sulfites (these are preferred). Use may also be made of hydrazines, examples of which are disclosed in Japanese Patent Application Kokai (JP-A) No. 146041/1988. Most often, hydroxylamine and diethylhydroxylamine are converted into salts such as sulfate, hydrochloride, p-toluenesulfonate, oxalate, and citrate salts because they are desirably used in solid form in the practice of the invention.

The amount of hydroxylamine and diethylhydroxylamine added generally ranges from 0.01 to 0.1 mol, preferably from 0.03 to 0.07 mol per liter of the color developer while the amount of sulfite added generally ranges from 0.005 to 0.08 mol, preferably from 0.01 to 0.05 mol per liter of the color developer. Since the sulfites are more competitive with color developing reaction, they should be used in smaller amounts in order to promote color development and quicken processing. For this reason, the amount of sulfite added should preferably range from 0.03 to 0 mol, especially from 0.02 to 0.005 mol per liter of the color developer. The use of sulfite in such limited amounts is recommended for the processing of high silver chloride content (e.g., silver chloride 95 mol % or higher) photosensitive materials.

Also preferred are hydroxylamine compounds of the general formula (I) given below. These hydroxylamine compounds are effective in preventing decomposition of the color developing agent and thus insuring consistent finish. They are also effective in prohibiting tar formation resulting from decomposition of the color developing agent and restraining stain generation. Since they themselves have less influence on photographic performance, more consistent finish is available.

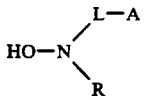

Formula (I)

In the formula, L is a substituted or unsubstituted alkylene group, preferably a straight or branched one having 1 to 10 carbon atoms, especially 1 to 5 carbon atoms. Preferred examples are methylene, ethylene, trimethylene and propylene. The substituents on the alkylene group include carboxyl, sulfo, phosphono, phosphinic acid residue, hydroxyl, optionally alkyl substituted ammonio groups, with the carboxyl, sulfo, phosphono, and hydroxyl groups being preferred.

A is selected from carboxyl, sulfo, phosphono, phosphinic acid residue, hydroxyl, optionally alkyl substituted amino groups, optionally alkyl substituted ammonio groups, optionally alkyl substituted carbamoyl groups, optionally alkyl substituted sulfamoyl groups, substituted or substituted alkylsulfonyl groups, with the carboxyl, sulfo, hydroxyl, phosphono and optionally alkyl substituted carbamoyl groups being preferred.

Preferred examples of the -L-A linkage include carboxymethyl, carboxyethyl, carboxypropyl, sulfoethyl, sulfopropyl, sulfobutyl, phosphonomethyl, phosphonoethyl, and hydroxyethyl groups Most preferred are carboxymethyl, carboxyethyl, sulfoethyl, sulfopropyl, phosphonomethyl, and phosphonoethyl groups.

R is a hydrogen atom or a substituted or unsubstituted alkyl group. The alkyl groups are preferably straight or branched ones having 1 to 10 carbon atoms, especially 1 to 5 carbon atoms. The substituents on the alkyl group include carboxyl, sulfo, phosphono, phosphinic acid residue, hydroxyl groups, optionally alkyl substituted amino groups, optionally alkyl substituted ammonio groups, optionally alkyl substituted carbamoyl groups, optionally alkyl substituted sulfamoyl groups, substituted or unsubstituted alkylsulfonyl groups, acylamino, alkylsulfonylamino, arylsulfonylamino, alkoxycarbonyl, arylsulfonyl, nitro, cyano groups, and halogen atoms. The alkyl group represented by R may have more than one substituent. Preferably, R is selected from a hydrogen atom, carboxylmethyl, carboxyethyl, carboxypropyl, sulfoethyl, sulfopropyl, sulfobutyl, phosphonomethyl, phosphonoethyl, and hydroxyethyl groups, with the hydrogen, carboxylmethyl, carboxyethyl, sulfoethyl, sulfopropyl, phosphonomethyl, and phosphonoethyl groups being most preferred. It is to be noted that L and R taken together may form a ring.

The hydroxylamine compound of formula (I) may take the form of a salt.

Examples of the hydroxylamine compound of formula (I) are given below.

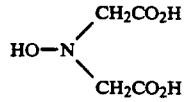

(I-1)

-continued (I-2)

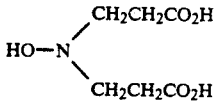

(I-3)

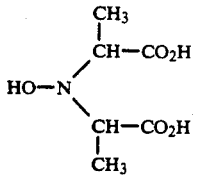

(I-4)

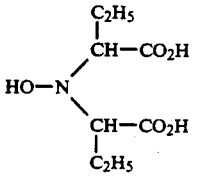

(I-5)

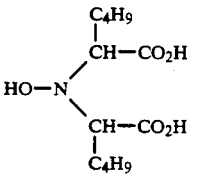

(I-6)

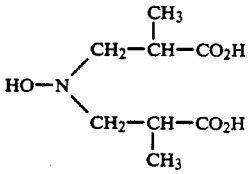

(I-7)

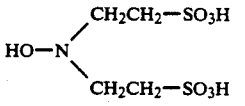

(I-8)

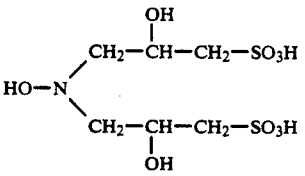

(I-9)

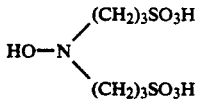

(I-10)

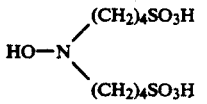

(I-11)

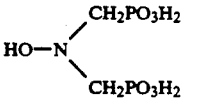

The amount of formula (I) compound used preferably ranges from 0.1 to 50 grams, more preferably from 0.2 to 20 grams per liter of the color developer.

In the composition of the invention, a variety of chelating agents may be used for water softening and metal shielding purposes. The chelating agents are solid.

Examples of the chelating agent include diethylenetriaminepentaacetic acid, nitrilotrimethylene phosphonic acid, nitrilotriacetic acid, hydroxyethyliminodiacetic acid, 1,2-dihydroxybenzene-3,5-disulfonic acid, catecholtrisulfonic acid, ethylenediaminetetraacetic acid, ethylenediaminetetramethylenephosphonic acid, and diaminopropanol tetraacetic acid.

These chelating agents may take the form of free acids, alkali metal salts such as sodium and potassium salts, and ammonium salts. They are acidic compounds in free organic acid form and in salt form, some are acidic, but most are neutral or alkaline compounds. Most often, they are used in the form of organic acids in the practice of the invention.

The antifoggants used herein include alkali metal halides, preferably alkali metal bromides such as potassium bromide, sodium bromide, and lithium bromide. Potassium chloride or the like is also useful.

The antifoggant is added to the color developer in amounts of up to 0.02 mol per liter of the color developer for the purposes of controlling fog and gradation, preferably in amounts of up to 0.015 mol/liter for quicker development.

Various antifoggants may be used also for the purposes of restraining fog and improving discrimination. Preferred examples of the antifoggant include benzotriazole, 5-methylbenzotriazole, 6-nitrobenzimidazole, 5-phenyltetrazole, 1-phenyl-5-mercaptotetrazole, and other organic antifoggants as disclosed in L.F.A. Mason, Photographic Processing Chemistry, 2nd Ed. (1975), pages 39–42. The amount of anti-foggant used is also set forth therein. Also useful are 4-hydroxy-6-methyl-1,3,3a,7-tetraazaindene and other anti-foggants as disclosed in T.H. James, The Theory of Photographic Process, 4th Ed., pages 398–399. They may be added amounts to the organic antifoggants. Among these antifoggants, the halides are neutral salts and the organic antifoggants are solid and neutral compounds.

For quicker development, it is recommended to add various development promoters to the color developer. Exemplary development promoters are the compounds set forth in Mason's book, pages 41–44, optionally in combination with black-and-white developing agents set forth ibid., pages 15–29. Especially preferred are pyrazolidones such as 1-phenyl-3-pyrazolidone, p-aminophenols, and tetramethyl-p-phenylenediamine. The amount of development promoter used preferably ranges from 0.001 to 0.1 gram, more preferably from 0.003 to 0.05 grams per liter of the color developer.

Since these development promoters are generally solid and approximately neutral compounds, they are preferably located in the layered arrangement of the present invention adjacent the color developing agent layer and the organic acid or neutral salt layer.

In general, the color developer prepared from the composition of the invention is adjusted to pH 9.5 to 12, preferably pH 10.2 to 12, more preferably pH 10.5 to 11.5 for quicker processing. An increase in pH is effective in promoting both silver development and color development reaction, especially color development of a cyan dye.

Such a pH level is obtained by adding an alkaline agent which is usually selected from alkali metal hydroxides such as potassium hydroxide and sodium hydroxide in the practice of the invention. A pH increase is preferably achieved by increasing the amount of an alkali metal hydroxide as the alkaline agent as well as increasing the amount of a pH buffer as the alkaline agent. Therefore, the amount of alkali metal hydroxide added ranges from 0.02 to 0.4 mol, preferably from 0.05 to 0.25 mol per liter of the color developer while the amount of pH buffer added ranges from 0.2 to 1.0 mol, preferably from 0.3 to 0.8 mol, more preferably from 0.35 to 0.5 mol per liter of the color developer.

The color development process may proceed in two or more baths at different pH levels. For example, a first bath developer at pH 9 or lower for brief processing is followed by a second bath developer at pH 10.5 or higher, thereby adjusting the balance of development process between upper and lower layers.

On processing with the color developer prepared from the vacuum packaged color developing composition of the present invention, the development temperature generally ranges from 25° to 50° C., although relatively higher temperatures of 33° to 48° C., especially 35° to 45° C. are often selected for quicker processing.

The developing time is usually up to 3 minutes 30 seconds. The developing time is the time taken from the point when the leading edge of a length of photosensitive material is immersed in the developer to the point when it is immersed in another processing solution of a subsequent step. In this sense, the developing time includes a spatial transfer time between the development step and the subsequent step. Usually, the spatial transfer time is about 1 to 30 seconds although a shorter spatial transfer time, for example, of up to 15 seconds, especially up to 10 seconds is recommended for achieving quicker processing for which the present invention is intended.

In a preferred mode of processing, the color developer is successively utilized by making up its replenisher. The replenisher should contain the components which are consumed during development or exhausted upon aging in necessary amounts to make up such losses. Therefore, the replenisher usually contains the requisite components in larger amounts than the mother or tank developer, typically in 10 to 50% larger amounts as compared with the tank developer.

It is understood that since bromides are dissolved out of the photosensitive material during development, the content of bromide in the replenisher should preferably be lower than in the tank developer and be reduced as the amount of replenisher added is reduced. For example, where the amount of replenisher added is less than 700 ml per square meter of photosensitive material, the bromide content of the replenisher should preferably be less than 0.004 mol/liter. If the replenisher amount is less than 500 ml, the bromide content of the replenisher should preferably be less than 0.003 mol/liter. If the replenisher amount is further reduced, the bromide might be eliminated.

The present invention is applicable to the preparation of such replenisher as long as the proportion of components is changed to meet the replenisher composition.

The photosensitive material which has been processed for color development with the color developer according to the present invention is then processed according to a predetermined schedule.

Usually, the color development step is followed by a desilvering step. In the desilvering step, bleaching and fixation may be carried out either at the same time (bleach-fixing) or separately. Any desired combination may be used for quicker processing, for example, bleaching followed by bleach-fixing as disclosed in JP-A 75352/1986, a procedure using two serially arranged bleach-fixing baths as disclosed in JP-A 91952/1987, fixing followed by bleach-fixing as disclosed in JP-A 51143/1986, and bleach-fixing followed by bleaching. The bleaching agents includes compounds of polyvalent metals such as iron (III), cobalt (III), chromium (IV), and copper (II), peracids, quinones, and nitro compounds. Typical bleaching agents are ferricyanides; bichromates; organic complex salts of iron (III) or cobalt (III), for example, complex salts of aminopolycarboxylic acids such as ethylenediaminetetraacetic acid, diethylenetriaminepentaacetic acid, cyclohexanediaminetetraacetic acid, methyliminodiactic acid, 1,3-diaminopropanetetraacetic acid, glycol ether diamine tetraacetic acid, and citric acid, tartaric acid and malic acid; persulfates; bromates; permanganates; and nitrobenzenes. Among these, aminopolycarboxylic acid-iron (III) complex salts as typified by iron (III) ethylenediaminetetraacetate and persulfates are preferred for quicker processing and environmental protection. Inter alia, aminopolycarboxylic acid-iron (III) complex salts are effective in both bleaching and bleach-fixing solutions. The bleaching and bleach-fixing solutions containing aminopolycarboxylic acid-iron (III) complex salts are generally at pH 5.5 to 8 although lower pH values are acceptable for quicker processing.

The fixing agents include thiosulfates, thiocyanates, thioethers, thioureas, and iodide salts. Often thiosulfates are used, and among them, ammonium thiosulfate is used most widely. The preservatives in the bleach-fixing solution include sulfites and bisulfites as well as carbonyl bisulfite adducts.

During processing with the bleaching and/or bleach-fixing solution, it is usually replenished in an amount of 200 to 1500 ml per square meter of picture-taking color photosensitive material although a replenisher amount of up to 800 ml/m$^2$, especially up to 500 ml/m$^2$ is preferred for simplicity. For printing color photosensitive material, the replenisher amount usually ranges from 25 to 500 ml/m$^2$ and a replenisher amount of up to 250 ml/m$^2$, especially up to 150 ml/m$^2$ is preferred for the same reason.

The bleach-fixing solution when used contains a fixing agent, preferably a thiosulfate in a concentration of 0.5 to 2 mol/liter.

For the bleaching, fixation and bleach-fixation, temperatures of 25° to 50° C. are generally used although temperatures of higher than 30° C., especially higher than 35° C. are preferred for quicker processing.

Moreover, the bleach-fixing solution when used preferably contains a bromide for the purpose of accelerating bleaching. Also in a preferred embodiment, means for capturing iodide ions such as an anion exchange resin is preferably used in order to remove iodide ions accumulating in the bleaching, bleach-fixing or fixing solution and to promote bleaching or fixing reaction. The bleaching, bleach-fixing or fixing solution may further contain antifungal agents and antibacterial agents such as isothiazolones, thiabendazoles, benzotriazoles, and quaternary ammonium compounds.

The desilvering step is followed by a washing and/or stabilizing step.

The washing and stabilizing solutions used in the washing and stabilizing steps preferably use deionized water as disclosed in Japanese Patent Application No. 131632/1986. There may be added antifungal and antibacterial agents such as isothiazolones as disclosed in JP-A 8542/1982 and thiabendazoles, benzotriazoles, and chlorinated isocyanurates. Water softening agents such as ethylenediaminetetraacetic acid and brighteners may also be added.

In addition to these agents, the stabilizer may contain image stabilizing agents such as formalin and ammonium salts.

Further, the washing and stabilizing solutions preferably contain surface active agents, especially nonionic surface active agents, for example, $$(n)C_{10}H_{21}-O-(CH_2CH_2O)_{10}-H,$$

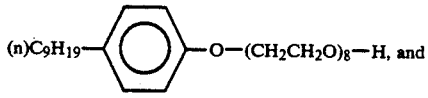

$$(n)C_9H_{19}-C_6H_4-O-(CH_2CH_2O)_8-H, \text{ and}$$

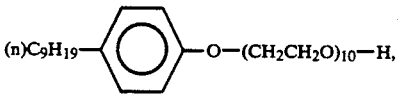

$$(n)C_9H_{19}-C_6H_4-O-(CH_2CH_2O)_{10}-H,$$

because washing or stabilizing efficiency is improved thereby.

The washing or stabilizing step usually utilizes a plurality of tanks, preferably in a multi-stage counter flow mode wherein washing or stabilizing solution is replenished from the last tank. Usually, 2 to 6 tanks are used, typically 2 to 4 tanks used.

The washing and stabilizing solutions are generally at pH 5 to 9, preferably pH 6 to 8. The processing time through the washing or stabilizing tank may be determined for a particular purpose, although it is preferably ½ to 5 minutes, especially ½ to 1½ minutes for quick processing. The temperature is 20° to 40° C. although a temperature of about 35° C. is used to promote washing for quicker processing.

In the washing and stabilizing tanks, the washing and stabilizing solution is made up in an amount of 100 to 500 ml per square meter of printing color photosensitive material and in an amount of 200 to 1200 ml per square meter of picture-taking color photosensitive material. The replenisher amount can be reduced to 400 ml/m$^2$ or less for printing color photosensitive material and 800 ml/m$^2$ or less for picture-taking color photosensitive material.

It is appreciated that the color development process may also be applied to reversal color development. This may be accomplished by providing a reversal bath subsequent to the first black-and-white development.

The concept of the present invention is applicable to not only the color developer, but also to other processing solutions such as bleaching, bleach-fixing, fixing and stabilizing solutions as well. Vacuum packaged processing compositions for respective processing solutions may be obtained according to the teaching of the present invention.

EXAMPLE

Examples of the present invention are given below by way of illustration and not by way of limitation.

Example 1

The components of a color developer are shown below. All these components are available in the form of powder or solid.

| Components | Amount |
|---|---|
| Alkaline agent: | |
| Potassium hydroxide | 12.5 g |
| Potassium carbonate | 345 g |
| Sodium hydrogen carbonate | 20 g |
| Preservative: | |
| Sodium sulfite | 40 g |
| Hydroxylamine sulfate monohydrate | 24 g |
| Water softener: | 40 g |
| Diethylenetriaminepentaacetic acid | |
| Color developing agent: | 46 g |
| 4-amino-3-methyl-N-ethyl-N-(β-hydroxyethyl)aniline sulfate | |
| Antifoggant: | 14 g |
| Potassium bromide | |

These components were packaged in slender bags of aluminum foil surface coated with 120 μm thick low density polyethylene resin by the following procedures. The resulting packages were designated Packages 1 to 11 in accordance with their packaging procedures.

Package 1 (comparison)

The components in the above-mentioned amounts were thoroughly blended and placed in a bag, which was sealed under atmospheric pressure.

Package 2 (comparison)

The components in the above-mentioned amounts were thoroughly blended and then placed in a bag, which was sealed under a vacuum of 20 mmHg.

Packages 3–11

The components were successively admitted into a bag to provide a layered arrangement (specified below) therein and the bag was sealed under a vacuum of 20 mmHg. The bottom layer component was admitted first and then lower to upper layer components were admitted. Each of the stacked layers consisted of a single component in the above-mentioned amount unless otherwise stated. The number of layers is also reported. The layered block had a height of about 15 to 20 cm in a stacking direction.

| | |
|---|---|
| Package 3 (eight layers, comparison) | |
| Potassium hydroxide | |
| Potassium carbonate | |
| Sodium hydrogen carbonate | |
| Color developing agent | |
| Potassium bromide | |
| Hydroxylamine sulfate | |
| Diethylenetriaminepentaacetic acid | |
| Sodium sulfite | |
| Package 4 (eight layers, invention) | |
| Potassium hydroxide | |
| Potassium carbonate | |
| Sodium hydrogen carbonate | |
| Sodium sulfite | |
| Potassium bromide | |
| Hydroxylamine sulfate | |
| Diethylenetriaminepentaacetic acid | |
| Color developing agent | |
| Package 5 (nine layers, invention) | |
| Potassium hydroxide | |
| Potassium carbonate | |
| Sodium hydrogen carbonate | |
| Sodium sulfite | |
| Potassium bromide | 7 g*1 |
| Hydroxylamine sulfate | |
| Diethylenetriaminepentaacetic acid | |
| Potassium bromide | 7 g*1 |
| Color developing agent | |
| Package 6 (nine layers, invention) | |
| Potassium hydroxide | |
| Potassium carbonate | |

-continued

| | | |
|---|---|---|
| Sodium hydrogen carbonate | | |
| Sodium sulfite | | |
| Potassium bromide | | |
| Hydroxylamine sulfate | | |
| Diethylenetriaminepentaacetic acid | | |
| Sodium chloride | | 20 g*2 |
| Color developing agent | | |
| Package 7 (ten layers, invention) | | |
| Potassium hydroxide | | |
| Potassium carbonate | | |
| Sodium hydrogen carbonate | | |
| Sodium sulfite | | |
| Potassium bromide | | |
| Sodium chloride | | 10 g*2 |
| Hydroxylamine sulfate | | |
| Diethylenetriaminepentaacetic acid | | |
| Sodium chloride | | 10 g*2 |
| Color developing agent | | |
| Package 8 (five layers, invention)*3 | | |
| 5th layer | Potassium hydroxide | |
| | Potassium carbonate | |
| | Sodium hydrogen carbonate | |
| | Sodium sulfite | |
| 4th layer | Potassium bromide | 7 g*1 |
| 3rd layer | Hydroxylamine sulfate | |
| | Diethylenetriaminepentaacetic acid | |
| 2nd layer | Potassium bromide | 7 g*1 |
| | Sodium chloride | 10 g*2 |
| 1st layer | Color developing agent | |
| Package 9 (four layers, invention)*3 | | |
| 4th layer | Potassium hydroxide | |
| | Potassium carbonate | |
| | Sodium hydrogen carbonate | |
| | Sodium sulfite | |
| 3rd layer | Potassium bromide | |
| | Sodium chloride | |
| 2nd layer | Color developing agent | |
| 1st layer | Hydroxylamine sulfate | |
| | Diethylenetriaminepentaacetic acid | |
| Package 10 (six layers, invention)*3 | | |
| Potassium hydroxide + potassium carbonate + sodium hydrogen carbonate | | |
| Potassium bromide | | |
| Hydroxylamine sulfate | | |
| Diethylenetriaminepentaacetic acid | | |
| Color developing agent | | |
| Sodium sulfite | | |
| Package 11 (four layers, invention)*3 | | |
| 4th layer | Potassium hydroxide | |
| | Potassium carbonate | |
| | Sodium hydrogen carbonate | |
| | Sodium sulfite | |
| 3rd layer | Hydroxylamine sulfate | |
| 2nd layer | Potassium bromide | |
| | Diethylenetriaminepentaacetic acid | |
| 1st layer | Color developing agent | |

*1Potassium bromide was divided into two parts which were disposed as two different layers.
*2Sodium chloride was used as an inert layer since it is a component which does not alter developing capacity.
*3In some layers, a preblend of components was used to form the layer.

Packages 1 to 11 were stored for 4 weeks at a temperature of 60° C. and a relative humidity of 80% before their contents were dissolved in water to a total volume of 10 liters. The thus prepared solutions corresponding to Packages 1 to 11 are designated Color Developers I to XI, respectively. In the case of Packages 3 to 11, the layered block was introduced into 8 liters of water from the upper layer side and water was made up to a total volume of 10 liters.

Next, color negative films, Fuji Color Super HG 400 commercially available from Fuji Photo-Film Co., Ltd. were given wedge exposure at a color temperature of 4800° K. and 5 CMS and processed according to the following schedule.

| Step | Time | Temperature |
|---|---|---|
| Color development | 3'15" | 38.0° C. |
| Bleaching | 45" | 38.0° C. |
| Fixing | 1'30" | 38.0° C. |
| Washing (1) | 20" | 38.0° C. |
| Washing (2) | 20" | 38.0° C. |
| Stabilizing | 20" | 38.0° C. |
| Drying | 1'00" | 55.0° C. |

The color development step used Color Developers I to XI.

The other steps used the following processing solutions.

| | Tank solution |
|---|---|
| Bleaching solution | |
| Ammonium iron (III) 1,3-propanediaminetetraacetate | 0.25 mol |
| Ammonium bromide | 140.0 g |
| Ammonium nitrate | 30.0 g |
| Acetic acid (98%) | 25.0 ml |
| Glycolic acid | 70.0 g |
| Water | totaling to 1.0 liter |
| | pH 3.3 |
| Fixer | |
| 1-hydroxyethylidene-1,1-diphosphonic acid | 1.0 g |
| Ammonium sulfite | 12.0 g |
| Ammonium thiosulfate | 1.5 mol |
| Water | totaling to 1.0 liter |
| | pH 6.7 |

Wash water

City water was passed through a mixed bed column loaded with an H type strong acid cation-exchange resin (Amberlite ® IR-120B by Rohm & Haas Co.) and an OH type anion-exchange resin (Amberlite ® IR-400) to reduce the calcium and magnesium ion concentrations to 3 mg/l or lower. To the deionized water were added 20 mg/l of sodium isocyanurate dichloride and 150 mg/l of sodium sulfate. This liquid was at pH 6.5 to 7.5.

| Stabilizer | Tank solution |
|---|---|
| Triethanol amine | 2.0 g |
| Formalin (37%) | 2.0 ml |
| Polyoxyethylene-p-monononylphenylether (average polymerization degree 10) | 0.3 g |
| Disodium ethylenediaminetetraacetate | 0.05 g |
| Water | totaling to 1.0 liter |
| | pH 5.8–8.0 |

A fresh color developer was prepared as a reference developer by dissolving the above-listed components (which had been kept fresh in isolate form) in water to a total volume of 10 liters. Using the reference developer, a film was also processed according to the above schedule.

Color negative films which had been processed using the respective Color Developers I to XI were measured for magenta dye image sensitivity, average gradation, and fog. Table 1 reports the difference of these measurements from those of the reference film processed using the reference developer.

The photographic properties were measured as follows.

Fog

Fog is the minimum density of magenta.

Sensitivity

Sensitivity is a logarithm of the exposure corresponding to a density of fog +0.2.

Average gradation:

Gradation is obtained by subtracting fog +0.2 from a density corresponding to the exposure which is given as a sum of the exposure for the above sensitivity plus a logarithmic value of 1.5.

TABLE 1

| Color developer (pH) | | Package | Fog | Difference in Sensitivity | Gradation |
|---|---|---|---|---|---|
| I | (9.85) | 1 (comparison) | +0.21 | −0.18 | −0.24 |
| II | (9.95) | 2 (comparison) | +0.12 | −0.11 | −0.15 |
| III | (10.08) | 3 (comparison) | −0.04 | −0.08 | −0.10 |
| IV | (10.05) | 4 (invention) | −0.01 | −0.02 | −0.02 |
| V | (10.04) | 5 (invention) | 0.00 | −0.01 | −0.01 |
| VI | (10.05) | 6 (invention) | 0.00 | 0.00 | −0.03 |
| VII | (10.06) | 7 (invention) | 0.00 | 0.00 | −0.03 |
| VIII | (10.05) | 8 (invention) | 0.00 | 0.00 | −0.02 |
| IX | (10.05) | 9 (invention) | −0.02 | −0.06 | −0.03 |
| X | (10.05) | 10 (invention) | 0.00 | −0.02 | −0.05 |
| XI | (10.05) | 11 (invention) | +0.05 | −0.03 | −0.03 |

As seen from Table 1, processing with the color developers according to the present invention resulted in images of excellent photographic properties.

Package 9, though falling within the scope of the invention, was less desirable because the arrangement of the layer containing a preservative (hydroxylamine sulfate) adjacent the developing agent layer resulted in a substantial lowering of sensitivity. Also, Packages 10 and 11 were less desirable though falling within the scope of the invention. The preservative (sodium sulfite) layer was disposed adjacent the developing agent layer in Package 10, and the preservative (hydroxylamine sulfate) disposed adjacent the alkaline agent in Package 11. The sodium sulfite in contact with the developing agent resulted in an increased gradation difference while the hydroxylamine in contact with the alkaline agent resulted in increased fog.

Example 2

The components of a color developer are shown below. All these components are available in the form of powder or solid.

| Components | Amount |
|---|---|
| Alkaline agent: | |
| Potassium hydroxide | 50 g |
| Potassium carbonate | 263 g |
| Sodium hydrogen carbonate | 20 g |
| Preservative: | |
| Disulfoethylhydroxylamine | 60 g |
| Sodium sulfite | 0.2 g |
| Water softener: | |
| Nitrilotrimethylenephosphonic acid | 30 g |
| Diethylenetriaminepentaacetic acid | 20 g |
| Brightener: | 20 g |
| Triazinylstilbene brightener | |
| Color developing agent: | 60 g |
| 4-amino-3-methyl-N-ethyl-N-(β-methanesulfonamidoethyl)aniline sulfate | |
| Antifoggant: | 40 g |
| Potassium chloride | |

These components were packaged in slender bags of aluminum foil surface coated with polyethylene resin by the following procedures. The resulting packages were designated Packages a to k in accordance with their packaging procedures.

Package a (comparison)

The components in the above-mentioned amounts were thoroughly blended and then placed in a bag, which was sealed under atmospheric pressure.

Package b (comparison)

The components in the above-mentioned amounts were thoroughly blended and then placed in a bag, which was sealed under a vacuum of 10 mmHg.

Packages c–k

The components were successively admitted into a bag to provide a layered arrangement (shown below) therein and the bag was sealed under a vacuum of 10 mmHg. The bottom layer component was admitted first and then lower to upper layer components were admitted. The stacked layers each consisted of a single component in the above-mentioned amount unless otherwise stated. The number of layers is also reported. The layered block had a height of about 15 to 20 cm in a stacking direction.

Package c (ten layers, comparison)
Color developing agent
Potassium carbonate
Sodium hydrogen carbonate
Sodium sulfite
Potassium hydroxide
Brightener (A-13)
Di(sulfoethyl)hydroxylamine
Nitrilotrimethylenephosphonic acid
Diethylenetriaminepentaacetic acid
Potassium chloride Package d (ten layers, invention)
Potassium hydroxide
Potassium carbonate
Sodium hydrogen carbonate
Sodium sulfite
Brightener (A-13)
Di(sulfoethyl)hydroxylamine
Nitrilotrimethylenephosphonic acid
Diethylenetriaminepentaacetic acid
Potassium chloride
Color developing agent Package e (ten layers, invention)
Potassium hydroxide
Potassium carbonate
Sodium hydrogen carbonate
Sodium sulfite
Brightener (A-13)
Di(sulfoethyl)hydroxylamine
Potassium chloride
Nitrilotrimethylenephosphonic acid
Diethylenetriaminepentaacetic acid
Color developing agent Package f (ten layers, invention)
Potassium hydroxide
Potassium carbonate
Sodium hydrogen carbonate
Sodium sulfite
Potassium chloride
Di(sulfoethyl)hydroxylamine
Nitrilotrimethylenephosphonic acid
Diethylenetriaminepentaacetic acid
Brightener (A-13)
Color developing agent Package g (ten layers, invention)
Potassium hydroxide
Potassium carbonate
Sodium hydrogen carbonate
Sodium sulfite
Brightener (A-13)
Di(sulfoethyl)hydroxylamine
Nitrilotrimethylenephosphonic acid
Diethylenetriaminepentaacetic acid
Potassium chloride
Color developing agent Package h (eleven layers, invention)
Potassium hydroxide -continued

| | | |
|---|---|---|
| Potassium carbonate | | |
| Sodium hydrogen carbonate | | |
| Sodium sulfite | | |
| Brightener (A-13) | | |
| Di(sulfoethyl)hydroxylamine | | |
| Potassium chloride | | 20 g*4 |
| Nitrilotrimethylenephosphonic acid | | |
| Diethylenetriaminepentaacetic acid | | |
| Potassium chloride | | 20 g*4 |
| Color developing agent | | |
| Package i (five layers, invention)*3 | | |
| 5th layer | Potassium hydroxide | |
| | Potassium carbonate | |
| | Sodium hydrogen carbonate | |
| | Sodium sulfite | |
| 4th layer | Brightener (A-13) | |
| 3rd layer | Di(sulfoethyl)hydroxylamine | |
| 2nd layer | Potassium chloride | |
| | Nitrilotrimethylenephosphonic acid | |
| | Diethylenetriaminepentaacetic acid | |
| 1st layer | Color developing agent | |
| Package j (five layers, invention)*3 | | |
| 5th layer | Potassium hydroxide | |
| | Potassium carbonate | |
| | Sodium hydrogen carbonate | |
| | Sodium sulfite | |
| 4th layer | Brightener (A-13) | |
| | Potassium chloride | |
| 3rd layer | Nitrilotrimethylenephosphonic acid | |
| | Diethylenetriaminepentaacetic acid | |
| 2nd layer | Color developing agent | |
| 1st layer | Di(sulfoethyl)hydroxylamine | |
| Package k (four layers, invention)*3 | | |
| 4th layer | Potassium hydroxide | |
| | Potassium carbonate | |
| | Sodium hydrogen carbonate | |
| | Sodium sulfite | |
| 3rd layer | Di(sulfoethyl)hydroxylamine | |
| 2nd layer | Brightener (A-13) | |
| | Potassium chloride | |
| | Nitrilotrimethylenephosphonic acid | |
| | Diethylenetriaminepentaacetic acid | |
| 1st layer | Color developing agent | |

*3In some layers, a preblend of components was used to form the layer.
*4Potassium chloride was divided into two parts which were disposed as two different layers.

Packages a to k were stored for 4 weeks at a temperature of 60° C. and a relative humidity of 80% before their contents were dissolved in water to a total volume of 10 liters. The thus prepared solutions corresponding to Packages a to k are designated Color Developers A to K, respectively. In the case of Packages c to k, the layered block was introduced into water from the upper layer side as in Example 1.

Next, color papers, Fuji Color Paper Super FA commercially available from Fuji Photo-Film Co., Ltd. were given wedge exposure at a color temperature of 2850° K. and 250 CMS and processed according to the following schedule.

| Step | Time | Temperature |
|---|---|---|
| Color development | 45" | 38.0° C. |
| Bleach-fixing | 45" | 38.0° C. |
| Washing (1) | 15" | 38.0° C. |
| Washing (2) | 15" | 38.0° C. |
| Washing (3) | 15" | 38.0° C. |
| Washing (4) | 15" | 38.0° C. |
| Drying | 50" | 75.0° C. |

The color development step used Color Developers A to H.

The other steps used the following processing solutions.

| Bleach-fixing solution | Tank solution |
|---|---|
| Water | 700 ml |
| Aqueous ammonium thiosulfate (700 g/l) | 100 ml |
| Ammonium sulfite | 18 g |
| Ammonium iron (III) ethylenediaminetetraacetate dihydrate | 55 g |
| Disodium ethylenediaminetetraacetate dihydrate | 3 g |
| Ammonium bromide | 40 g |
| Glacial acetic acid | 8 g |
| Water | totaling to 1000 ml |
| | pH (25° C.) 5.5 |

Wash water

City water (calcium 23 mg/l, magnesium 3 mg/l, conductivity 170 μS/cm)

A fresh color developer was prepared as a reference developer by dissolving the above-listed components (which had been kept fresh in isolate form) in water to a total volume of 10 liters. Using the reference developer, a color paper was also processed according to the above schedule.

Sheets of color papers which had been processed using the respective Color Developers A to K were measured for cyan dye image sensitivity and fog. Table 2 reports the difference of these measurements from those of the reference film processed using the reference developer. It is to be noted that fog is the minimum density of cyan and sensitivity is a logarithm of the exposure corresponding to a density of fog +0.5.

Further, Color Developers A to K were measured for the concentration of color developing agent both as prepared and after aging, determining the percent retention of color developing agent after aging. The results are also shown in Table 2.

TABLE 2

| Color developer (pH) | Package | Developing agent Retention | Difference in Fog | Difference in Sensitivity |
|---|---|---|---|---|
| A (9.80) | a (comparison) | 73% | +0.15 | −0.10 |
| B (9.96) | b (comparison) | 86% | +0.11 | −0.07 |
| C (10.19) | c (comparison) | 79% | +0.08 | −0.09 |
| D (10.15) | d (invention) | 96% | +0.01 | −0.02 |
| E (10.16) | e (invention) | 94% | 0.00 | −0.02 |
| F (10.14) | f (invention) | 93% | 0.00 | −0.03 |
| G (10.15) | g (invention) | 97% | 0.00 | −0.02 |
| H (10.16) | h (invention) | 96% | 0.00 | −0.01 |
| I (10.15) | i (invention) | 96% | 0.00 | −0.01 |
| J (10.15) | j (invention) | 89% | +0.01 | −0.05 |
| K (10.15) | k (invention) | 96% | +0.03 | −0.04 |

As seen from Table 2, the color developing agent in the packages of the present invention changed little its nature and quantity during storage, and processing therewith resulted in images of excellent photographic properties.

Package j was less desirable though falling within the scope of the invention. The arrangement of the preservative layer adjacent the developing agent layer resulted in a substantial lowering of sensitivity since the preservative promoted deterioration of the developing agent as opposed to expectation. Package i using a preblend of some components performed well. Package k was less desirable, though falling within the scope of the invention, since the arrangement of the preservative (di(sulfoethyl)hydroxylamine) layer adjacent the alkaline agent layer resulted in increased fog and somewhat increased sensitivity drop.

The layer arrangement that the preservative layer adjoined the color developing agent layer resulted in a more or less lowering of photographic properties. When the preservative used was a sulfite, the sulfite decomposed to release undesirable sulfur dioxide gas during storage or upon dissolving in water.

Example 3

In Example 2, 1.5 grams of polymer (b-9) was mixed into the layer adjoining the developing agent layer.

| Package l (five layers, invention) | |
|---|---|
| 5th layer | Potassium hydroxide |
| | Potassium carbonate |
| | Sodium hydrogen carbonate |
| | Sodium sulfite |
| 4th layer | Brightener (A-13) |
| 3rd layer | Di(sulfoethyl)hydroxylamine |
| 2nd layer | Potassium chloride |
| | Nitrilotrimethylenephosphonic acid |
| | Diethylenetriaminepentaacetic acid |
| | Polymer (B-9) |
| 1st layer | Color developing agent |

The results were satisfactory including a retention of the developing agent of 94%, a fog difference of +0.01, and a sensitivity difference of −0.03.

Example 4

Example 2 was repeated except that the bleach-fixing solution was prepared by dissolving a vacuum packaged bleach-fixing composition and an acetic acid solution, both defined below, in 10 liters of water.

| Vacuum packaged bleach-fixing composition | |
|---|---|
| Ammonium thiosulfate | 700 g* |
| Ammonium sulfite | 180 g* |
| Sodium p-toluenesulfinate | 150 g |
| Disodium ethylenediaminetetraacetate dihydrate | 30 g |
| Ferric ethylenediaminetetraacetate ammonium dihydrate | 550 g |
| Acetic acid solution | |
| Water | 100 ml |
| Glacial acetic acid | 80 g |

*previously blended

The results were substantially equivalent to those of Example 2.

Example 5

In Example 2, 10 grams of surfactant (C-3) was mixed into the layer adjoining the developing agent layer.

| Package m (six layers, invention) | |
|---|---|
| 6th layer | Potassium hydroxide |
| | Potassium carbonate |
| | Sodium hydrogen carbonate |
| | Sodium sulfite |
| 5th layer | Brightener (A-13) |
| 4th layer | Di(sulfoethyl)hydroxylamine |
| 3rd layer | Potassium chloride |
| 2nd layer | Nitrilotrimethylenephosphonic acid |
| | Diethylenetriaminepentaacetic acid |
| | Surfactant (C-3) |
| 1st layer | Color developing agent |

The results were satisfactory including a retention of the developing agent of 94%, a fog difference of ±0, and a sensitivity difference of −0.03.

Example 6

A color developer composition for silver chloride based color paper having the following layer arrangement was packaged in a low-density polyethylene bag of 150 μm thick and sealed under a vacuum of 10 mmHg. The package was stored for 8 weeks in a 40° C./70% RH environment.

| Package n (five layers, invention) | | |
|---|---|---|
| 5th layer | Potassium hydroxide | 45 g |
| | Potassium carbonate | 280 g |
| | Sodium hydrogen carbonate | 25 g |
| 4th layer | Potassium chloride | 45 g |
| | Polymer (B-8) | 10 g |
| | Brightener (A-15) | 20 g |
| | Potassium bromide | 0.1 g |
| 3rd layer | N,N-diethylhydroxylamine sulfate | 70 g |
| 2nd layer | 1,2-dihydroxybenzene-3,5-disulfonic acid | 20 g |
| | Ethylenediaminetetraacetic acid | 10 g |
| | Surfactant (D-3) | 30 g |
| 1st layer | (β-methanesulfonamidoethyl)aniline sesquisulfate monohydrate | 60 g |

Each of the second, fourth and fifth layers was formed from a preblend of components.

For comparison purpose, Package o was prepared by previously blending all the components, that is, without layer arrangement.

At the end of storage, Packages n and o were dissolved in 10 liters of water to form Color Developers N and O, which were chemically analyzed to determine how the selected chemical agents were retained as compared with their initial charge.

| Color Developer | N | O |
|---|---|---|
| Color developing agent | 96% | 74% |
| N,N-diethylhydroxylamine sulfate | 92% | 65% |

The data show that Package n within the scope of the present invention could retain the color developing agent and the preservative (diethylhydroxylamine sulfate) intact and was excellent in storage stability.

Using Color Developers N and O, sheets of color paper were processed as in Example 2. Color Developers N and O gave a differential fog density of +0.007 and +0.04, respectively, relative to a fresh color developer which was separately prepared as a reference developer. That is, Color Developer N within the scope of the present invention experienced a minimal fog increase.

The color developing composition in layered arrangement according to the present invention experiences little or no lowering in activity during shelf storage and is ready for preparing a color developer having sufficient capability to produce images of improved photographic properties. Preparation of a color developer from the packaged composition is quite simple. The package is compact, easy and safe to handle, presenting a saving of transportation cost.

Although some preferred embodiments have been described, many modifications and variations may be made thereto in the light of the above teachings. It is therefore to be understood that within the scope of the appended claims, the invention may be practiced otherwise than as specifically described.

I claim:

1. A vacuum packaged color developing composition comprising an aromatic primary amine color developing agent and other components, wherein at least five solid state layers each consisting of a different component or components from the other layers are received in a container in a vacuum sealed manner, a first layer containing the color developing agent is disposed adjacent to a second layer containing at least one main component selected from the group consisting of an organic acid, a brightener, a polymer, a surface active agent and a neutral salt, a third layer containing a preservative, a fourth layer containing a component selected from the group consisting of an organic acid, a brightener, a polymer, a surface active agent and a neutral salt, and a fifth layer containing an alkaline agent, said layers being stacked in the described order.

2. A vacuum package comprising a container and a color developing composition comprising an aromatic primary amine color developing agent and other components vacuum packaged therein, wherein at least five solid state layers of different combinations of the components are received in the container in a vacuum sealed manner, a first layer containing the color developing agent is disposed adjacent a second layer containing at least one main component selected from the group consisting of an organic acid, a brightener, a polymer, a surface active agent and a neutral salt, a third layer containing a preservative, a fourth layer containing a component selected from the group consisting of an organic acid, a brightener, a polymer, a surface active agent and a neutral salt, and a fifth layer containing an alkaline agent, said layers being stacked in the described order.

3. The vacuum packaged composition of claim 1, wherein said layers are stacked so that the fifth layer containing an alkaline agent is released first from the container upon use into a predetermined volume of water to obtain a color developing solution.

4. The vacuum package of claim 2, wherein the layers are stacked so that the fifth layer containing an alkaline agent is released first from the container upon use into a predetermined volume of water to obtain a color developing solution.

5. The vacuum packaged composition of claim 1, wherein the color developing composition is introduced into a predetermined amount of water to obtain a color developing solution, the container is adapted to sequentially release the solid state layers in accordance with the layer stacking order, and the layers are stacked so that the fifth layer containing an alkaline agent is released first from the container upon use.

6. The vacuum package of claim 2, wherein the color developing composition is introduced into a predetermined volume of water to obtain a color developing solution, the container is adapted to sequentially release the solid state layers in accordance with the layer stacking order, and the layers are stacked so that the fifth layer containing an alkaline agent is released first from the container upon use.

* * * * *